US007833061B2

(12) United States Patent
Hori et al.

(10) Patent No.: US 7,833,061 B2
(45) Date of Patent: Nov. 16, 2010

(54) ELECTRONIC PART CONNECTOR

(75) Inventors: Takayuki Hori, Yamato (JP); Akira Kawaguchi, Yamato (JP); Hisaya Suzuki, Fujieda (JP); Akira Fukai, Fujieda (JP); Masahiro Motomiya, Fujieda (JP)

(73) Assignees: Molex Incorporated, Lisle, IL (US); Murakami Corporation, Shizuoka (JP)

( * ) Notice: Subject to any disclaimer, the term of this patent is extended or adjusted under 35 U.S.C. 154(b) by 13 days.

(21) Appl. No.: 11/887,795

(22) PCT Filed: Apr. 5, 2006

(86) PCT No.: PCT/US2006/012958

§ 371 (c)(1),
(2), (4) Date: Mar. 2, 2009

(87) PCT Pub. No.: WO2006/108119

PCT Pub. Date: Oct. 12, 2006

(65) Prior Publication Data

US 2009/0215293 A1 Aug. 27, 2009

(30) Foreign Application Priority Data

Apr. 5, 2005 (JP) ..... 2005-108677

(51) Int. Cl.
*H01R 13/66* (2006.01)

(52) U.S. Cl. ..... 439/620.21; 439/862

(58) Field of Classification Search ..... 439/620.21, 439/620.29–32, 862, 468
See application file for complete search history.

(56) References Cited

U.S. PATENT DOCUMENTS

| | | | | |
|---|---|---|---|---|
| 5,057,041 | A | 10/1991 | Yu et al. | |
| 5,221,215 | A | 6/1993 | Tan et al. | |
| 5,846,098 | A | 12/1998 | Shiga et al. | |
| 6,592,410 | B2 * | 7/2003 | Yoshida et al. | 439/701 |
| 7,011,548 | B2 * | 3/2006 | Bogiel et al. | 439/630 |
| 2002/0132533 | A1 * | 9/2002 | Figueroa | 439/862 |
| 2003/0073355 | A1 * | 4/2003 | Kawamura et al. | 439/862 |
| 2004/0161975 | A1 | 8/2004 | Sakai et al. | |

FOREIGN PATENT DOCUMENTS

| | | |
|---|---|---|
| EP | 0 502 377 A2 | 9/1992 |
| FR | 2 828 017 | 1/2003 |
| JP | 11-086980 | 3/1999 |

OTHER PUBLICATIONS

International Search Report for PCT/US06/012958.

* cited by examiner

*Primary Examiner*—Hien Vu
(74) *Attorney, Agent, or Firm*—Larry I. Golden

(57) ABSTRACT

To provide a connector that incorporates a built-in electronic part, which allows for easy assembly for obtaining a required connection structure, ensures connection reliability, and prevents dislodging of the electronic part even when used in locations involving frequent vibrations.

5 Claims, 12 Drawing Sheets

ELECTRONIC PART CONNECTOR

TECHNICAL FIELD

The present invention relates to an electronic part connector incorporating a built-in electronic part for removing the noise of a motor or the like.

BACKGROUND

In electric door mirrors for an automobile, for example, a motor is usually mounted as a drive source for changing the angle of the mirror surface. Upon activating the motor, electrical machinery parts of the motor generate noise. In this regard, for example, electronic equipment, such as a sensor or camera of various kinds, is often mounted to the door mirror or in the vicinity thereof. In such a case, the noise from the motor exerts adverse influences such as causing disturbances in various signals transmitted to the electronic equipment such as a sensor or camera, so it is necessary to remove the noise. To this end, an electronic part serving as a noise filter is conventionally provided between a power supply wire for supplying power to the motor and a ground wire.

In such a case, generally, when a condenser is to be disposed as the electronic part by wiring, the coatings of the power supply wire and ground wire are stripped off at their intermediate portions, and the electronic part such as a condenser is soldered in between the two wires. This often leads to an enlarged size of the connector and a reduction in reliability resulting from the electronic part falling off from the soldered portion. Further, an additional processing is necessary for covering the stripped portion, such as winding an insulating tape around the stripped portion, resulting in a large number of operation steps and poor operability.

On the other hand, as an example of connectors that do not require operations such as soldering when mounting a condenser, there is one described in Patent Document JP 11-86980 A

DISCLOSURE OF THE INVENTION

However, the connector described in Patent Document 1 uses the connector pin of the connector in order to place the condenser on the board and hence does not involve wire connection.

Further, in the connector described in Patent Document 1, the condenser mounted is open on one surface side. The connector thus lacks in reliability because the condenser may come off when the connector is used under conditions involving vibration or impact.

The present invention has been made in view of the circumstances described above, and therefore it is an object of the present invention to provide a connector which allows easy assembly for obtaining a required connection structure while incorporating an electronic part built therein, and which ensures connection reliability and prevents dislodging of the electronic part even when used under conditions involving frequent vibrations.

To attain the above object, the present invention adopts the following means. That is, according to the present invention, there is provided an electronic part connector having a pair of electronic part connecting terminals, one being connected to a power supply side and the other being connected to a grounding side, connection between the power supply side and the grounding side being established by interposing an electronic part between the one and the other of the pair of electronic part connecting terminals, the electronic part connector including a housing having the pair of electronic part connecting terminals and the electronic part mounted therein, characterized in that: assuming that an X-axis direction is a horizontal direction, a Y-axis direction is a horizontal direction orthogonal to the X-axis direction, and a Z-axis direction is a vertical direction, in the Y-axis direction, the pair of electronic part connecting terminals press and hold both end portions of the electronic part in mutually opposite directions, and in the Z-axis direction, the pair of electronic part connecting terminals come into contact with a side surface of the electronic part to hold the electronic part at a predetermined position; and each of the pair of electronic part connecting terminals includes a main contact portion that comes into contact with and exerts an elastic force on an end portion of the electronic part to press and hold the electronic part in the Y-axis direction, and an auxiliary contact portion that is substantially orthogonal to a contact surface of the main contact portion and protrudes in the Y-axis direction with respect to the main contact portion to reach a side portion of the electronic part.

The one of the pair of electronic part connecting terminals is connected to the power supply side for supplying power to a member to be supplied with power, such as a motor that generates noise, and the other is connected to the grounding side. The electronic part held by those electronic part connecting terminals serves to remove the noise of the motor or the like that is the member to be supplied with power. The term "electronic part" as used herein refers to, for example, a part having the function of a noise filter, such as a condenser, a resistor, or a filter.

Further, the connector may further include a male terminal which is connected to the power supply side or the grounding side at one end and to a member to be supplied with power at the other end, and which comes into contact with the one or the other of the pair of electronic part connecting terminals. Such a male terminal, which constitutes a terminal protruding from the housing of the connector, facilitates connection with another part.

It is preferable that, assuming that the X-axis direction is a direction orthogonal to the Y-axis direction in the same plane, wall portions that come into contact with or close to a side surface of the electronic part be formed within the housing to hold the electronic part in the X-axis direction. With this arrangement, the electronic part is held in the X-axis, Y-axis, and Z-axis directions, thereby preventing falling off, disconnection, or the like of the electronic part due to vibration or the like.

An electronic part connecting terminal that is to be built in the electronic part connector described above is constructed as follows. That is, the electronic part connecting terminal is characterized in that: assuming that an X-axis direction is a horizontal direction, a Y-axis direction is a horizontal direction orthogonal to the X-axis direction, and a Z-axis direction is a vertical direction, in the Y-axis direction, the pair of electronic part connecting terminals press and hold both end portions of the electronic part in mutually opposite directions, and in the Z-axis direction, the pair of electronic part connecting terminals come into contact with a side surface of the electronic part to hold the electronic part at a predetermined position; and each of the pair of electronic part connecting terminals includes a main contact portion that comes into contact with and exerts an elastic force on an end portion of the electronic part to press and hold the electronic part in the Y-axis direction, and an auxiliary contact portion that is substantially orthogonal to a contact surface of the main contact portion and protrudes in the Y-axis direction with respect to the main contact portion to reach a side portion of the electronic part.

Each of the pair of electronic part connecting terminals built in the connector of the present invention has a first contact surface provided in the main contact portion, the first contact surface coming into contact with an end portion of the electronic part, and the auxiliary contact portion is provided with a second contact surface that comes into contact with a side surface of the electronic part such that the auxiliary contact portion protrudes in the Y-axis direction in a flange-like manner. The auxiliary contact portion may be constructed such that it lies on a plane orthogonal to the plane on which the main contact portion is provided, and is extended so as to reach a side surface of the electronic part.

It is preferable that the pair of electronic part connecting terminals be composed of a pair of right and left parts that are plane symmetrical to each other, and that the electronic part be held between the right and left parts.

Further, a construction may be adopted in which the main contact portion is formed in a substantially U-shaped configuration to exhibit elasticity, and in which a sub contact portion is formed on a plane orthogonal to a plane on which the main contact portion is provided, the sub contact portion extending in a direction opposite to the auxiliary contact portion, being formed in a substantially U-shaped configuration to exhibit elasticity, and coming into contact with the male terminal connected to the power supply side or the grounding side.

Although the connector of the present invention is suitably used, for example, as a connector connected to a motor unit for driving a door mirror, this should not be construed restrictively. The present invention is applicable to a wide range of connectors which have an electric machinery part generating noise and to which an electronic part such as a condenser, a resistor, or a filter is connected to remove the noise.

With the connector according to the present invention, the electronic part is built in the housing, and the wiring and assembly of the respective terminals for obtaining a required connection structure are facilitated.

Further, the connection reliability is ensured, and the electronic part is prevented from falling out even when the connector is used in locations involving frequent vibrations.

Hereinbelow, an embodiment of the present invention will be described with reference to the accompanying drawings, FIGS. 1 through 14.

Hereinbelow, an embodiment of the present invention as applied to a mirror surface angle adjusting mechanism of a vehicle door mirror will be described with reference to the drawings.

First, a connector according to the present invention will be described. As shown in FIG. 1, in a connector 1, substantially L-shaped male terminals 3 inserted in a housing 2 are arranged in parallel at predetermined positions. Electric wires 26 are contact-bonded to one ends of the male terminals 3 which protrude in the horizontal direction (X-axis direction) as seen in the drawing, thus connecting the made terminals 3 to the power supply side and to the grounding side. It should be noted that the method of connecting the electric wires 26 to the male terminals 3 is not limited to contact bonding; any method enabling electrical connection, such as pressure welding, soldering, or pressing, may be selected as appropriate.

Further, male terminals 3*a* and 3*d* located at the opposite end portions of the housing 2 are connected to the power supply side, and male terminals 3*b* and 3*c* located on the center side are connected to the grounding side. As will be described later, the other ends of the male terminals 3*a* through 3*d* which are oriented in the vertical direction (Z-axis direction) are connected to first and second motors 11, 12 that are arranged in parallel above the housing 2 (see FIG. 1).

Mounted between the male terminals 3*a* and 3*b*, and between the male terminals 3*c* and 3*d*, are a condenser 4*a* and electronic part connecting terminals 5, and a condenser 4*b* and electronic part connecting terminals 5, respectively. In this way, the male terminals 3*a* and 3*b* are electrically connected through the condenser 4*a* and electronic part connecting terminals 5*a*, 5*b*. Likewise, the male terminals 3*c* and 3*d* are electrically connected through the condenser 4*b* and electronic part connecting terminals 5*c*, 5*d*.

FIG. 2 shows a state in which the condenser 4*a* (4*b*) is held between the two electronic part connecting terminals 5*a*, 5*b* (5*c*, 5*d*) (the details on the electronic part connecting terminals will be described later). In this way, within the housing 2 of the connector 1, the male terminals connected to the power supply side and the male terminals connected to the grounding side are connected through the condenser 4*a* (4*b*) used to remove noise generated by a motor unit 10.

A connector unit including the above-described connector of the present invention can be applied to, for example, a door mirror angle adjusting mechanism. Now, the general construction of such a door mirror angle adjusting mechanism incorporating the connector unit will be described.

As shown in FIG. 1, the motor unit 10 includes the first motor 11 for adjusting a holder angle with respect to the vertical axis direction of a vehicle, and the second motor 12 for adjusting the holder angle with respect to the lateral direction of the vehicle. The first and second motors 11, 12 are arranged in parallel and connected with the connector 1 for supplying electric power to the motors 11, 12. The first motor 11 is a side terminal type motor (see FIG. 6) having two female terminals 11*b*, 11*c* in its one side surface (the bottom surface in FIG. 1) at the rear end of the motor. Further, the second motor 12 is of completely the same construction as the first motor 11.

Further, when, as shown in FIG. 1, two side terminal type motors as described above are arranged in parallel to be incorporated into a casing 30 (FIG. 13) of the door mirror, the female terminals 11*b*, 11*c* of the first and second motors 11, 12 are oriented in the same direction.

Like a general-purpose angle adjusting mechanism, the angle adjusting mechanism according to this embodiment includes, for example, a holder having a mirror surface on its front surface side, a support portion supporting the holder from the rear surface side at a freely adjustable angle, and the casing 30 accommodating the motor unit 10 provided adjacent to the support portion (see FIG. 13). The casing 30 constitutes a part of the door mirror.

The connector 1 and the first and second motors 11, 12 are incorporated in the casing 30 in a layout as shown in FIGS. 1 and FIG. 14. With this layout, the wiring processing for the respective motors can be collectively performed in the space above the motors which otherwise becomes a dead space.

Further, a pinion gear, a worm gear, or the like (not shown) for turning the holder is attached to respective output shafts 11*a*, 12*a* of the first and second motors 11, 12. Accordingly, when electric power is supplied to the first and second motors 11, 12 as appropriate, the output shafts 11*a*, 12*a* thereof rotate, whereby the holder is supported at a desired angle.

As described above, the condenser 4*a* (4*b*), which is provided between the male terminal 3*a* (3*d*) connected to the power supply side and the male terminal 3*b* (3*c*) connected to the grounding side, is held by the electronic part connecting terminals 5 having a condenser holding function so that the condenser 4*a* (4*b*) does not fall off due to vibration or impact.

Hereinbelow, the electronic part connecting terminals 5 will be described.

FIG. 3 is a perspective view of the first electronic part connecting terminal 5*a* (5*c*) and the second electronic part connecting terminal 5*b* (5*d*) as opposed to each other.

The electronic part connecting terminal 5*a*, 5*b* (5*c*, 5*d*) is composed of a pair of right and left parts that are plane symmetrical to each other, that is, the first electronic part connecting terminal 5*a* (5*c*) and the second electronic part connecting terminal 5*b* (5*d*), with the condenser 4*a* (4*b*) being held therebetween.

As shown in FIGS. 3 and 4, the first electronic part connecting terminal 5*a* (5*c*) includes a main contact portion 15 formed by bending a metal plate member into a substantially U-shaped configuration, an inner wall portion 18 bent so as to be situated close to a distal end 15*a* of the main contact portion 15, and a canopy-like auxiliary contact portion 16 extending from the inner wall portion 18 so as to overlap the main contact portion 15 in the direction at a right angle to the main contact portion 15. The auxiliary contact portion 16 has at its distal end a second contact surface 16*b* that comes into contact with a side surface of the condenser 4*a* (4*b*).

Further, the first electronic part connecting terminal 5*a* has a sub contact portion 17 extending from the inner wall portion 18 in the direction opposite to the auxiliary contact portion 16 and formed in the same direction as the main contact portion 15 so as to have a substantially U-shaped configuration. The main contact portion 15 has on its outer side surface a first contact surface 15*b* angled so as to come into intimate contact with the side surface of the condenser.

The sub contact portion 17 is formed via a connecting portion 17*a* that is bent outwards at a right angle from a forward side edge of the inner wall portion 18, which is formed by folding over the read end of the main contact portion 15 so as to overlap the distal end 15*a*. The distal end extending at a right angle from the connecting portion 17*a* is folded over in the same direction as the main contact portion 15, thus forming the sub contact portion 17 having a substantially U-shaped configuration. The sub contact portion 17 is formed on the plane orthogonal to the plane on which the main contact portion 15 is formed.

The auxiliary contact portion 16 has a rectangular shape formed by bending the rear side end of the inner wall portion 18 at an angle of 180 degrees to the connecting portion 17*a* (at a right angle to the inner wall portion 18) so that the auxiliary contact portion 16 extends so as to overlap the main contact portion 15. The distal end of the auxiliary contact portion 16 protrudes outwards with respect to the first contact surface 15*b*.

It should be noted that the main contact portion 15 and the sub contact portion 17 which are substantially U shaped have a spring function, making it possible to absorb tolerances upon connection with the condenser or, as will be described later, upon connection with the male terminal to thereby ensure reliable connection. However, the configuration of the main contact portion 15 and sub contact portion 17 is not limited to the one obtained by bending them into a substantially U shape. Any configuration including, for example, a plate-like configuration or the like, may suffice as long as the contact with a target contact object such as a condenser can be maintained.

The first electronic part connecting terminal 5*a* has been described in the foregoing. As shown in FIG. 3, the second electronic part connecting terminal 5*b* has the main contact portion 15, the auxiliary contact portion 16, and the sub contact portion 17, and is formed so as to be plane symmetrical to the first electronic part connecting terminal 5*a*. Therefore, detailed description on the second electronic part connecting terminal 5*b* will be omitted by using the same reference symbols to denote the same or similar components.

FIG. 7 shows a state in which the first electronic part connecting terminal 5*a* and the second electronic part connecting terminal 5*b* hold the condenser 4*a* therebetween and are in contact with the male terminals 3*a*, 3*b*, respectively. It should be noted that, for the convenience of description, the housing 2 is omitted in FIG. 7. FIG. 7 clearly illustrates a state in which the first electronic part connecting terminal 5*a* and the second electronic part connecting terminal 5*b* contact the opposite ends of the condenser 4*a* and hold the condenser 4*a* therebetween.

It should be noted that the first electronic part connecting terminal 5*c* and the second electronic part connecting terminal 5*d*, which constitute a unit for supplying electric power to the second motor 12 and are arranged in parallel within the housing 2, hold the condenser 4*b* therebetween and are respectively in contact with the male terminals 3*c*, 3*d*. This state is completely the same as the state shown in FIG. 7 where the first electronic part connecting terminal 5*a* and the second electronic part connecting terminal 5*b* hold the condenser 4*a* therebetween and are respectively in contact with the male terminals 3*a*, 3*b*.

The male terminals 3*a*, 3*b*, which are constructed as shown in FIG. 5, are L-shaped as a whole and each have a plate-like contact member 25 provided at the portion bent at a right angle (the bottom portion in FIG. 5). The contact member 25 contacts the sub contact portion 17 of each of the first and second electronic part connecting terminals 5 so as to allow electrical conduction therebetween.

Further, the distal end side of the contact member 25 is contact-bonded with the electric wire 26 for connection to the power supply side or the grounding side. The rear end portion of the contact member 25 which extend in the vertical direction as seen in FIG. 5 is formed in a flat configuration so as to allow its insertion into each of the female terminals 11*b*, 11*c* of the first motor 11 or the second motor 12.

FIG. 8 is a perspective view showing the arrangement of the male terminal 3*b*, the first electronic part connecting terminal 5*a*, and the condenser 4*a* which are accommodated in the housing 2.

FIG. 8 is an enlarged perspective view showing a state in which the first electronic part connecting terminal 5*a* and the second electronic part connecting terminal 5*b* are incorporated in the housing 2 while holding the condenser 4*a* (4*b*) therebetween. As will be described later, the condenser 4*a* (4*b*) is inserted into the housing 2 in the Z-axis direction (vertical direction); at the inserted position, both side surfaces of the condenser 4*a* (4*b*) in the X-axis direction are in contact with or in close proximity to two opposing wall portions formed in the housing 2, that is, a first wall portion 20 and a second wall portion 21, and a protrusion 22. The condenser 4*a* is thus held by the first and second wall portions 20, 21, and the protrusion 22 so as not to move in the X-axis direction. The protrusion 22 provided in the surface of the second wall portion 21 serves to effect positioning upon inserting the condenser 4*a*.

FIG. 9 is a side view showing a state in which the male terminal 3*a* accommodated in the housing 2 and the first electronic part connecting terminal 5*a* are in contact with each other. In the state shown, the contact member 25 is in contact with a third contact portion 17*b* of the sub contact portion 17, which is in contact with the male terminal 3*a*. In this way, the male terminals 3 are connected to the first electronic part connecting terminals 5 via the condenser 4*a* (4*b*). The spring forces of the first electronic part connecting terminal 5*a* and second electronic part connecting terminal 5*b* act on the condenser 4*a* (4*b*), thereby reliably holding the condenser 4*a* (4*b*) in place while absorbing tolerances resulting from variations in the size, shape, or the like of the condenser.

Hereinbelow, the assembly process for the connector 1 of this embodiment will be described.

FIG. 10 is a view showing how the condensers 4*a*, 4*b* are inserted into predetermined positions (into the gap defined by the first wall portion 20, the second wall portion 21, and the protrusion 22) in the housing 2. Further, FIG. 11 is a view showing a state in which the condensers 4*a*, 4*b* have been inserted into the housing 2.

First, the condensers 4*a*, 4*b* are loaded into the housing 2. Next, the first and second electronic part connecting terminals 5*a* through 5*d* are inserted into the housing 2 in the X-axis direction. Since the condensers 4*a*, 4*b* have already been inserted, the first and second electronic part connecting terminals 5*a* through 5*d* are sequentially inserted such that the respective main contact portions 15 of the corresponding first and second electronic part connecting terminals 5*a* through 5*d* come into contact with both end portions 4*a*-1, 4*a*-2, and both end portions 4*b*-1, 4*b*-2, of the condensers 4*a*, 4*b*, respectively. FIG. 11 shows a state in which the first and second electronic part connecting terminals 5*a* through 5*d* are press-fitted into the housing 2.

Next, the L-shaped male terminals 3*a* through 3*d* are sequentially inserted into predetermined positions in the housing 2 in the X-axis direction. FIG. 12 shows a state in which the male terminals 3 are engaged in position inside the housing 2. The male terminals 3 are inserted in the X-axis direction of the housing 2 in correspondence with the respective first and second electronic part connecting terminals 5 such that the contact member 25 comes into contact with the third contact surface 17*b* of the sub contact portion 17.

When the above-described process is completed, the condenser 4*a* is held in position in the X-axis, Y-axis, and Z-axis directions, whereby disconnection of the condenser 4*a* from the housing 2 is prevented and good electrical contact is maintained.

The completed assembly including the housing provides a connector of high reliability because the respective pairs of the electronic part connecting terminals 5*a* through 5*d* are connected with a large connection force through the condensers 4*a*, 4*b*.

Further, in this embodiment, the power supply terminals (male terminals 3*a* and 3*b*) and the ground short-circuit terminals (male terminals 3*b* and 3*c*) are connected via the condensers 4*a*, 4*b* for absorbing noise generated by the first and second motors 11, 12. Accordingly, the incorporation of the condensers into the predetermined positions, and predetermined wiring and connection operations are all complete upon carrying out an assembling operation in a predetermined order.

Therefore, unlike the prior art, it is unnecessary to perform the processing for covering a stripped portion, such as stripping the coating of wires at the intermediate portion, soldering a condenser or the like in between the two electric wires, and then winding an insulating tape around the stripped portion, thereby achieving a considerable improvement in operation efficiency.

The male terminals 3*a*, 3*b* for supplying the external electric power, and the male terminals 3*b*, 3*c* serving as the external ground terminals, are each a machined product obtained by punching a conductive plate and bending the same.

Further, when the respective male terminals are inserted into the female terminals 11*b*, 11*c* formed in each of the first and second motors 11 (12), the respective male terminals and the female terminals on the motor side are connected with each other, whereby the connection between the male terminals and the electronic part connecting terminals, and the connection between those electronic part connecting terminals and the condensers are established by themselves.

It should be noted that the housing 2 includes a lid member (not shown), and that the connector 1 of the present invention is completed by closing the lid member after incorporating the respective terminals into the housing 2.

The above-described embodiment is given only by way of example, and the specific details thereof can be appropriately changed as desired. For example, the configurations of the electronic part connecting terminals 5, the male terminals 3, and the like are not limited to those of the above-described embodiment but may be changed as appropriate depending on the usage condition, the shapes of the condenser, motor, housing, and the like. In addition, as the method for connecting the motors and the male terminals with each other, it is possible to electrically connect them by soldering or via another connector.

Further, while in the above-described embodiment the electric connector of the present invention is employed for the angle adjusting mechanism for a vehicle door mirror, the electric connector of the present invention is applicable to the whole range of apparatuses using a motor unit incorporating multiple motors arranged in parallel.

Figure 1:
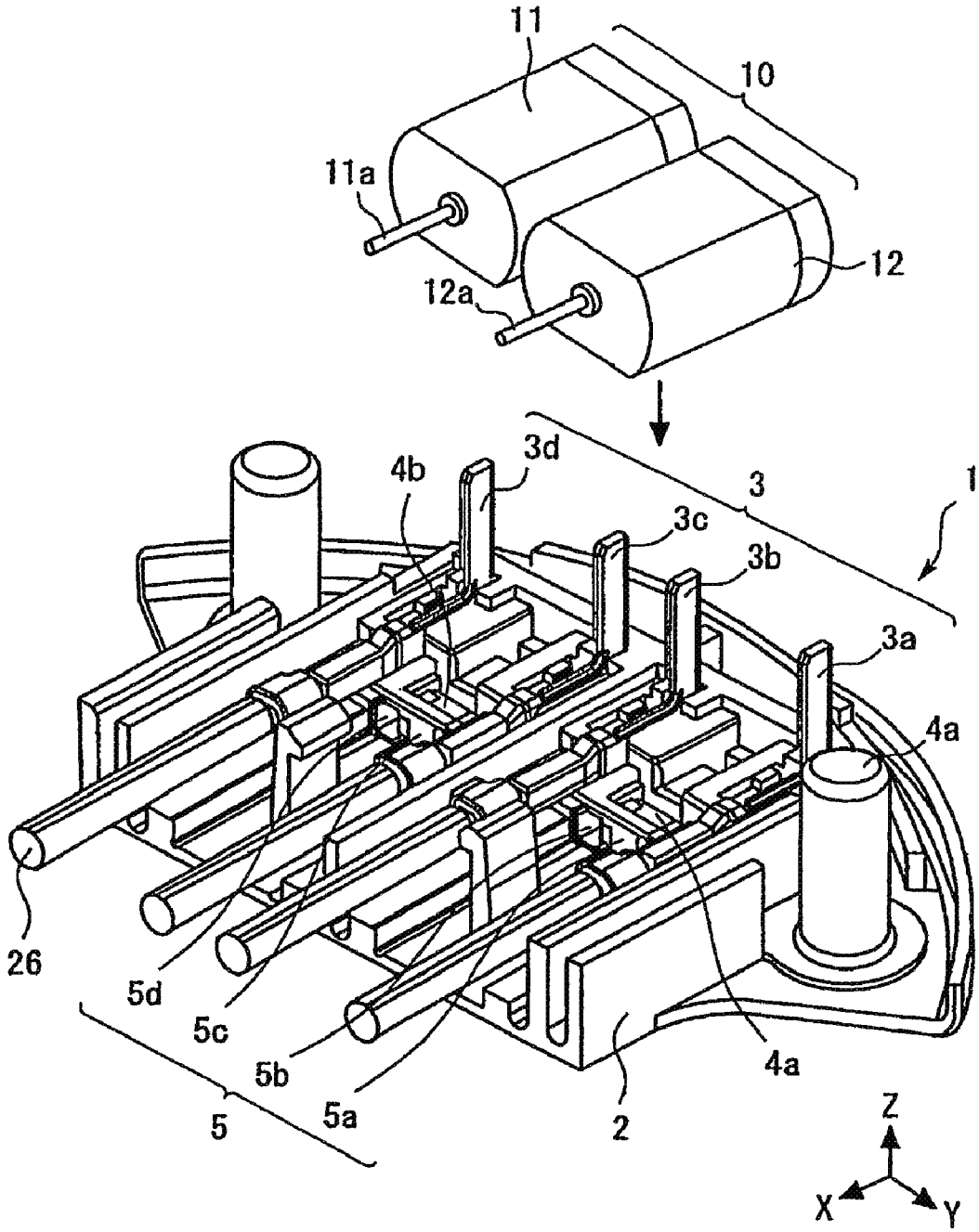
FIG. 1 A perspective view showing the inner structure of a connector according to the present invention and motors connected to the connector.
Figure 2:
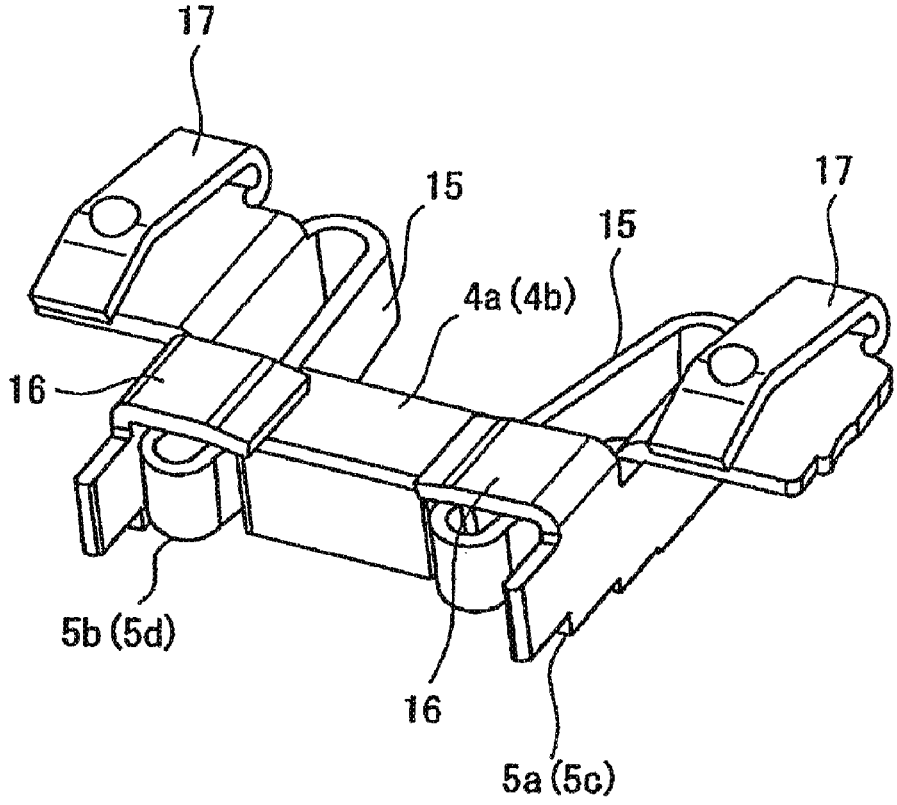
FIG. 2 A perspective view showing a state in which a pair of electronic part connecting terminals hold a condenser therebetween.
Figure 3:
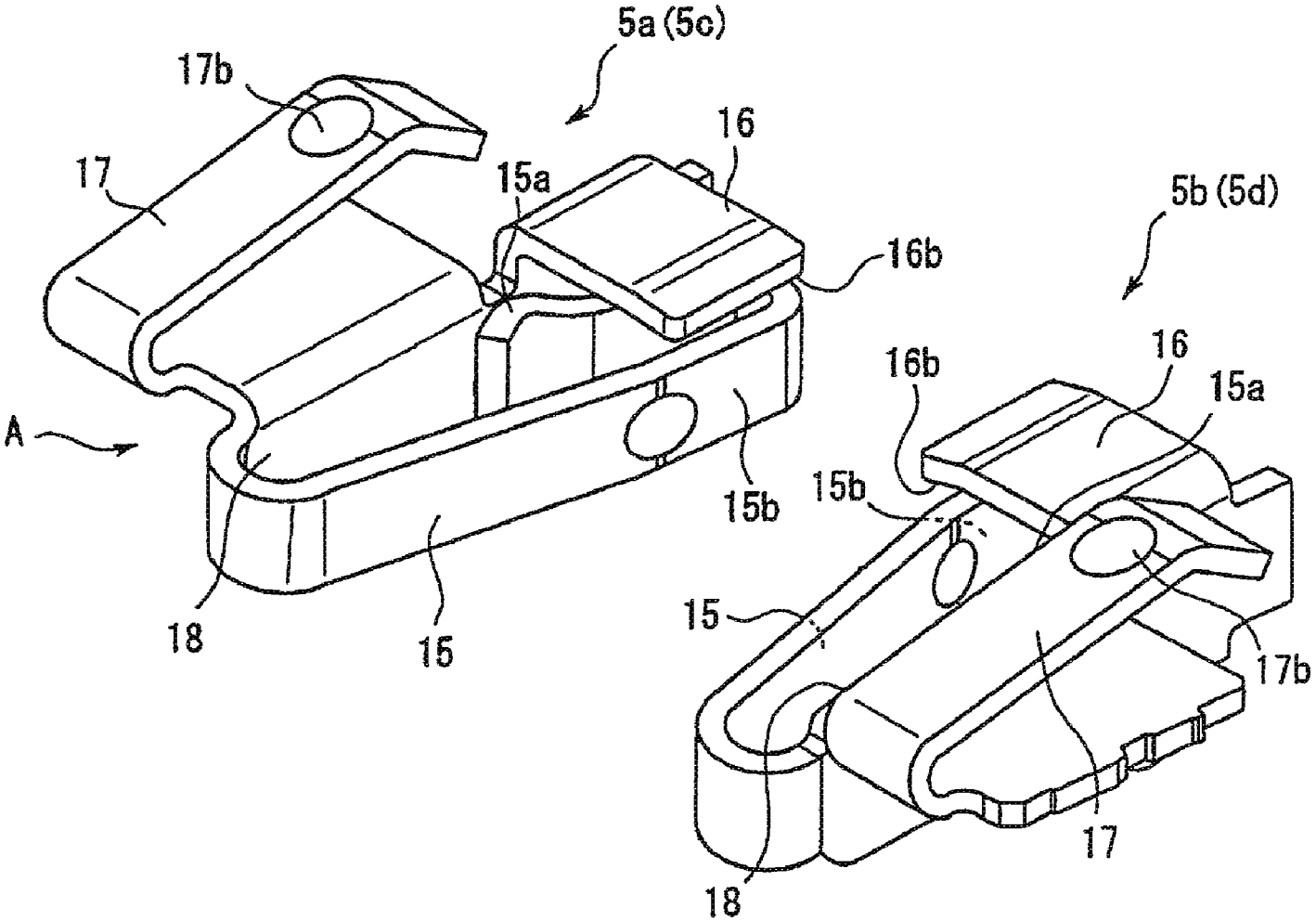
FIG. 3 A perspective view of a first electronic part connecting terminal and a second electronic part connecting terminal.
Figure 4:
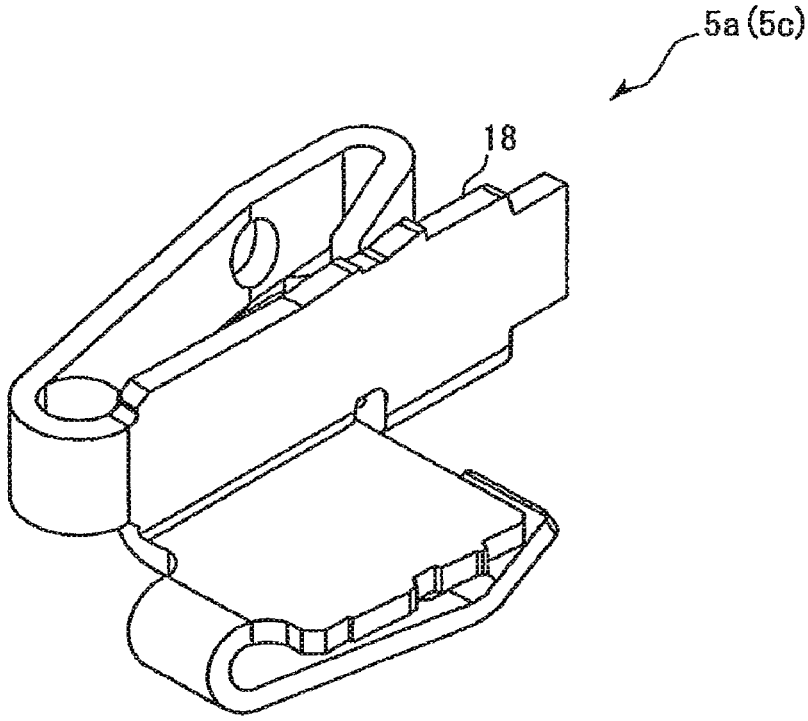
FIG. 4 A perspective view of the first electronic part connecting terminal as seen in the direction A of FIG. 3.
Figure 5:
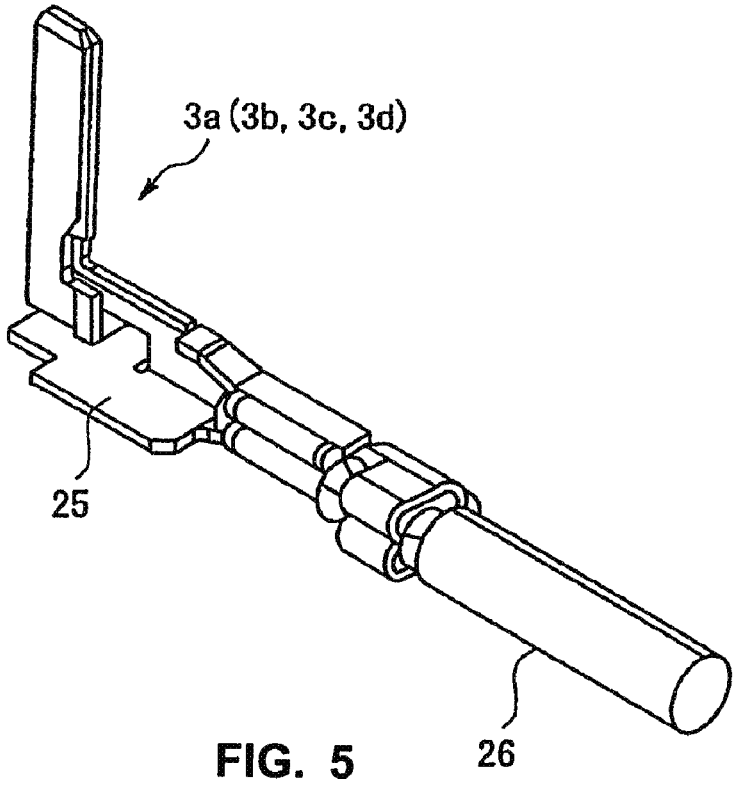
FIG. 5 An overall perspective view of a male terminal.
Figure 6:
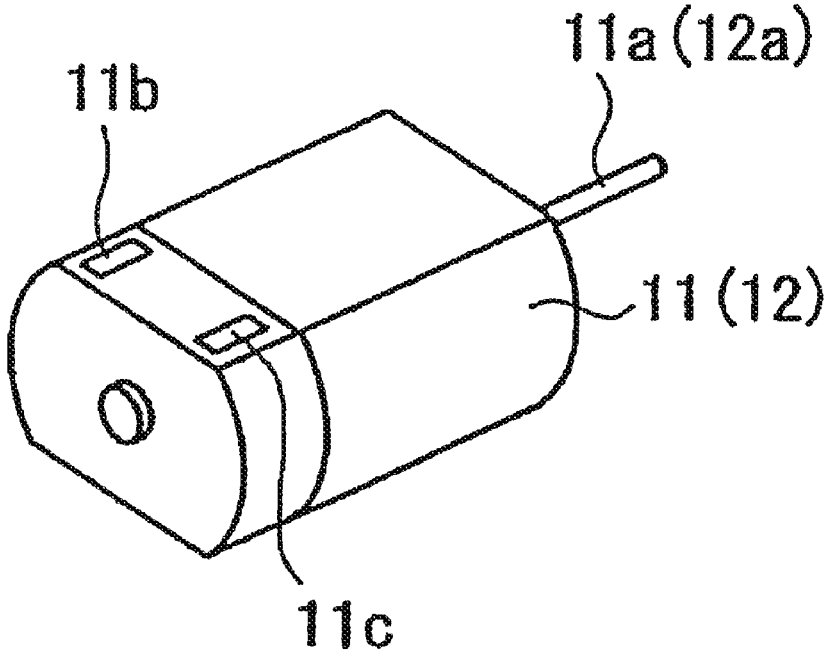
FIG. 6 A view showing a motor connected to the connector as a motor for changing a door mirror surface angle.
Figure 7:
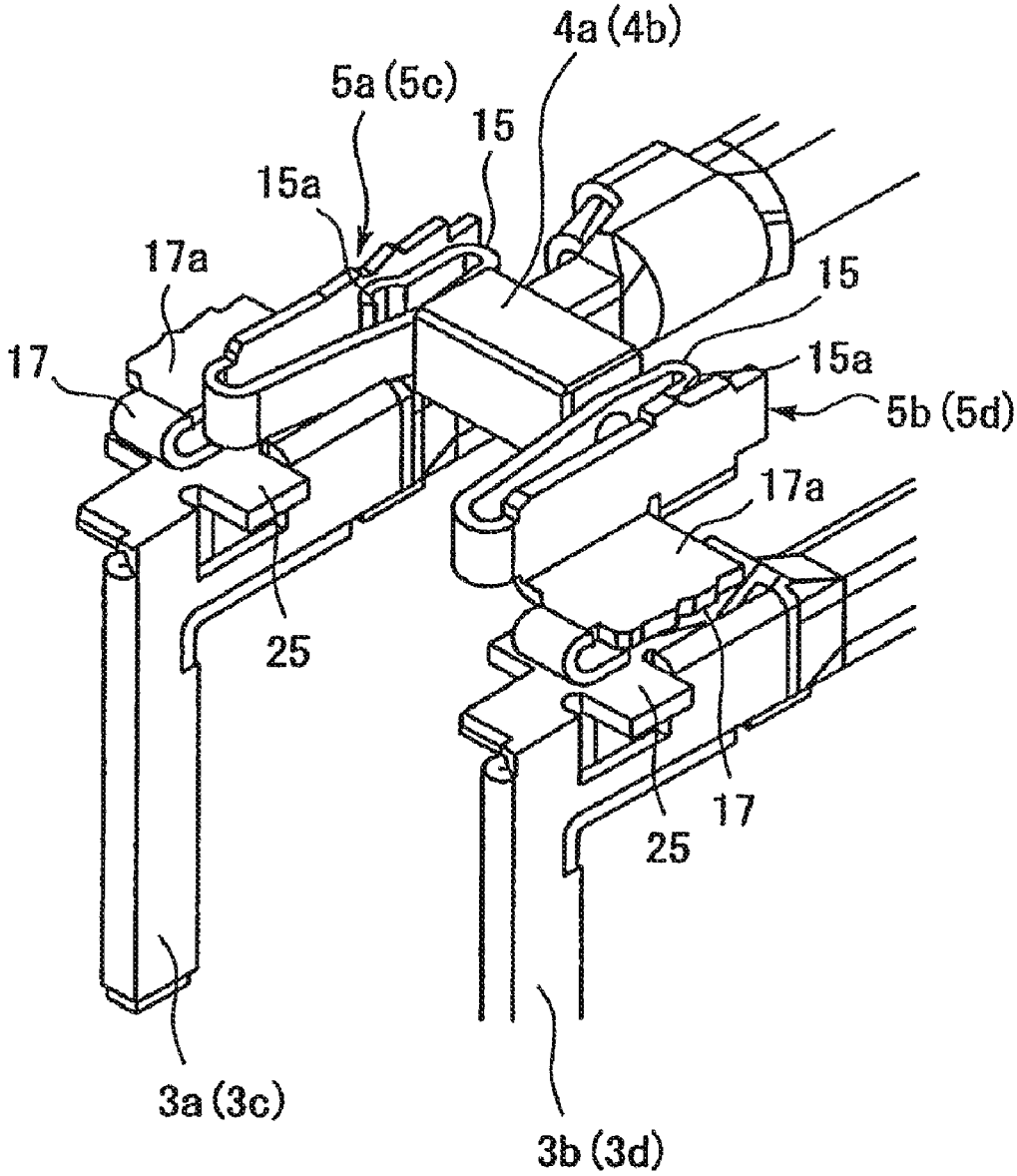
FIG. 7 A perspective view showing a state in which male terminals are in contact with the first electronic part connecting terminal and the second electronic part connecting terminal.
Figure 8:
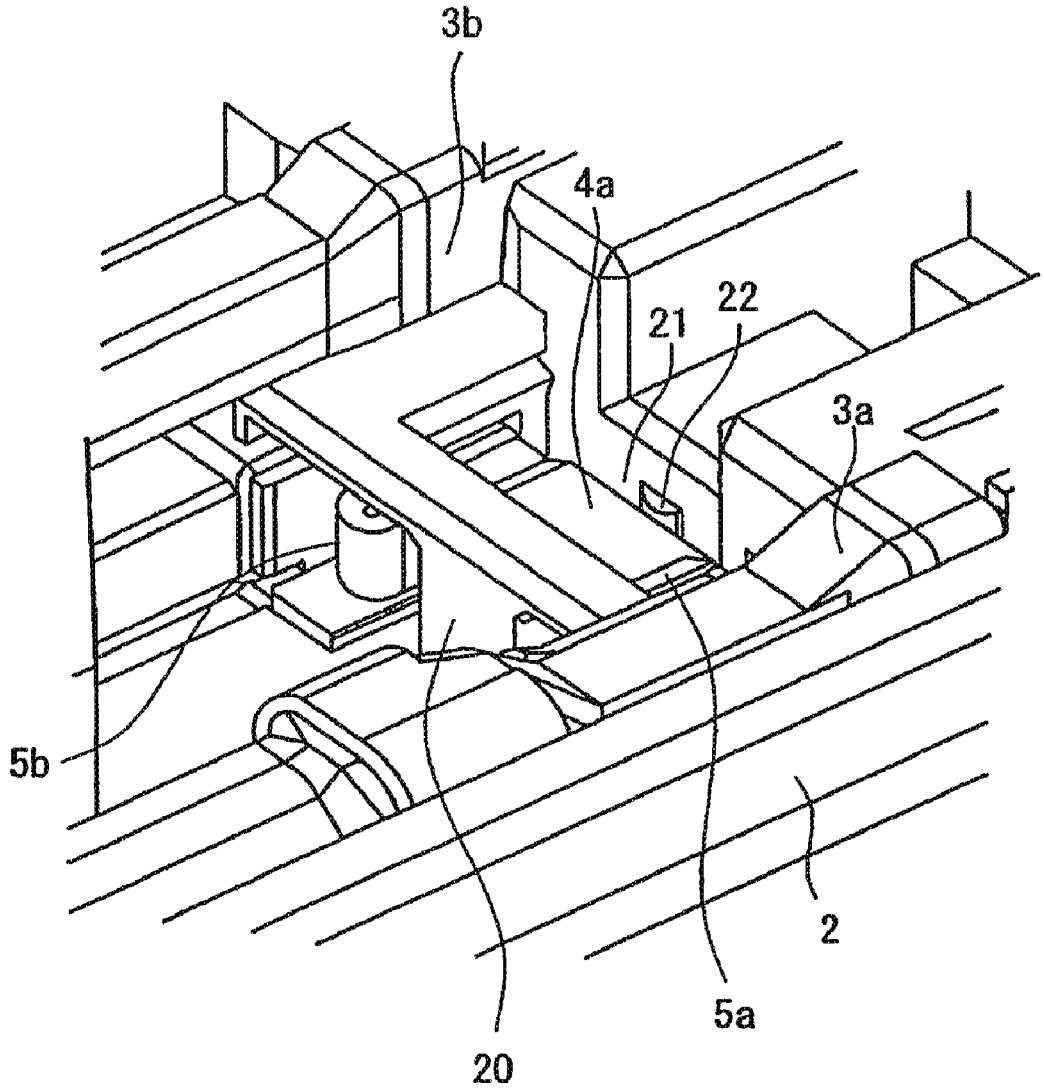
FIG. 8 A perspective view showing a state in which the electronic part connecting terminals and the male terminals are in contact with each other within a housing.
Figure 9:
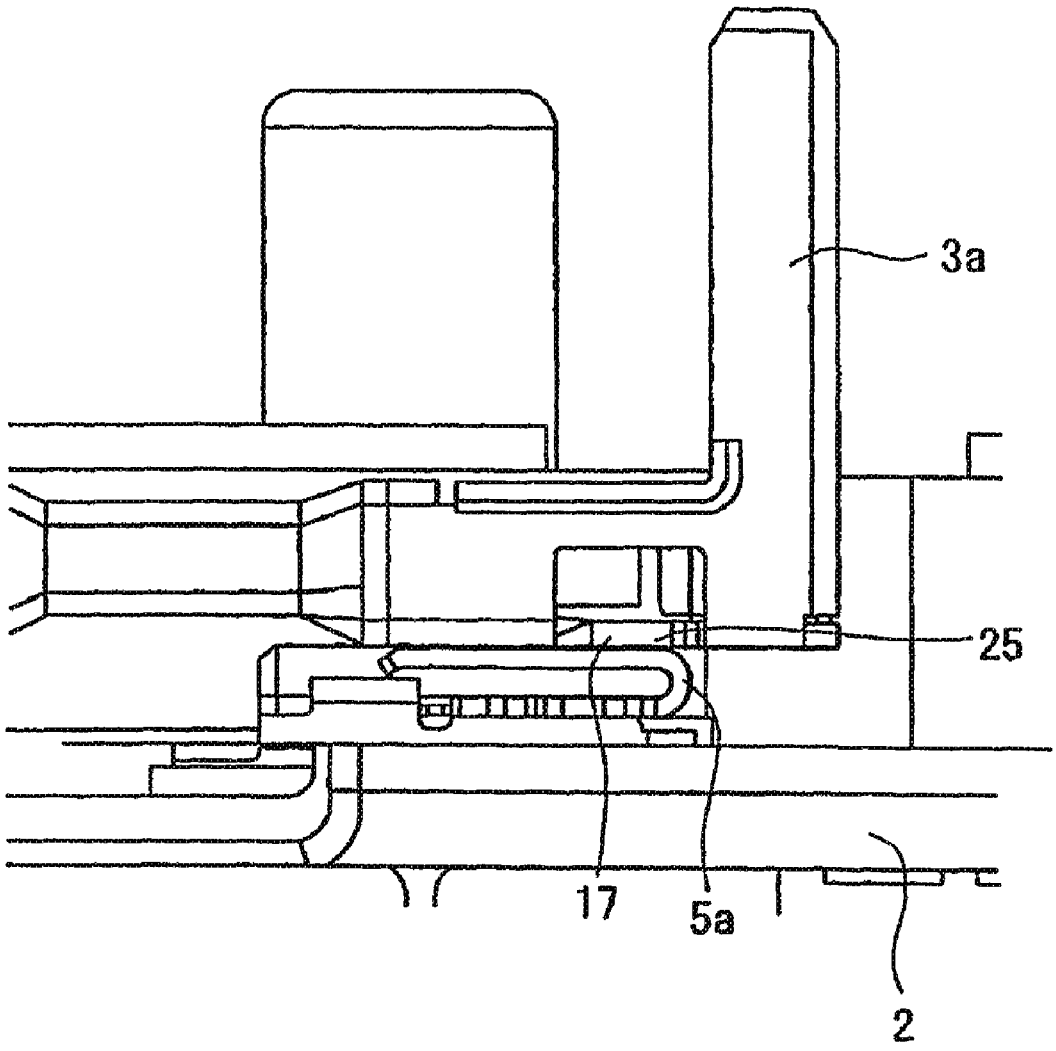
FIG. 9 A side view showing a state in which the electronic part connecting terminal and the male terminal are in contact with each other.
Figure 10:
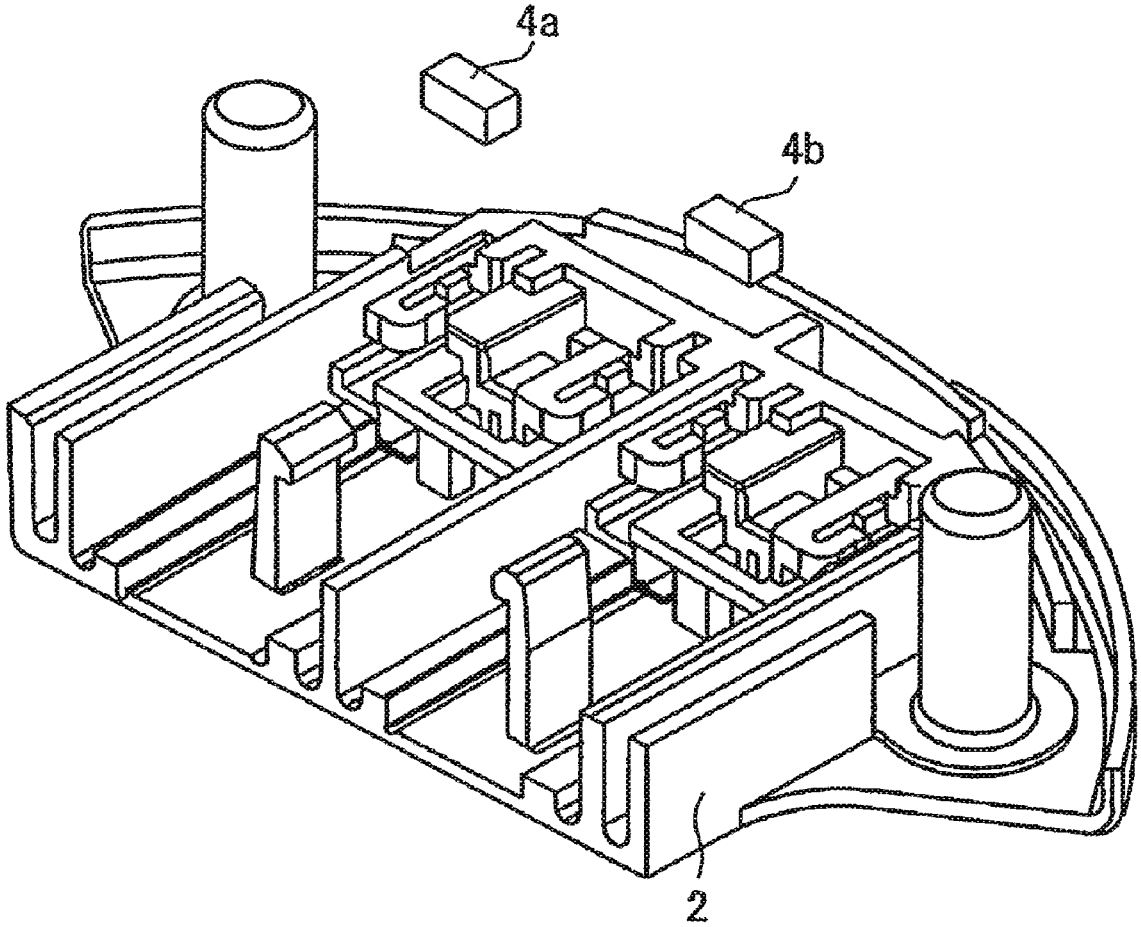
FIG. 10 A view showing how condensers are inserted into the housing.
Figure 11:
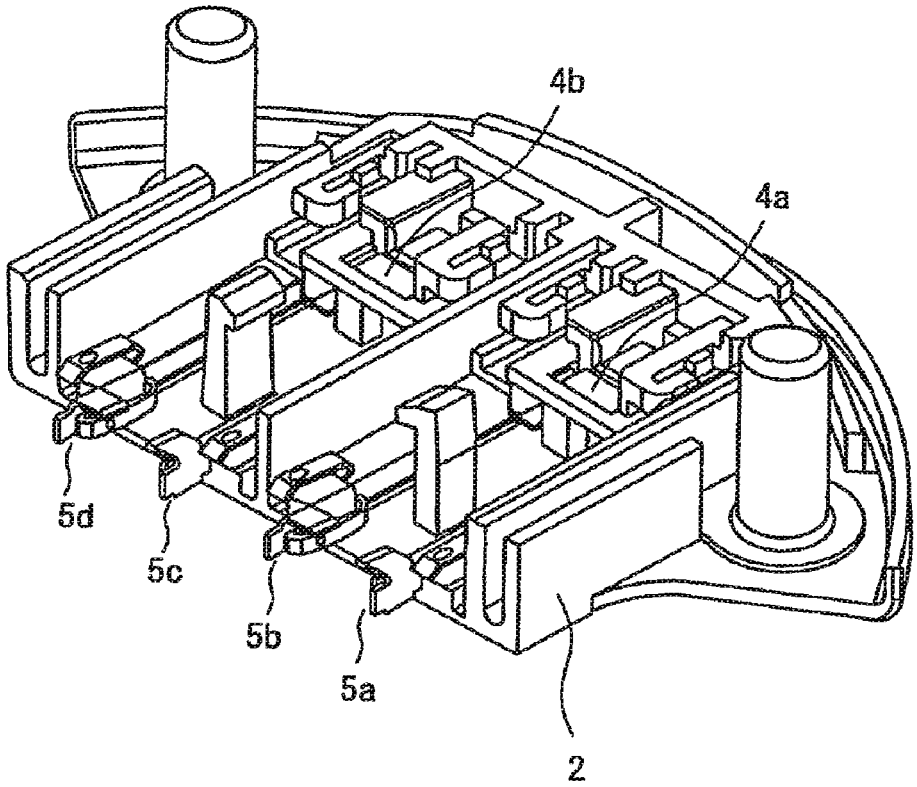
FIG. 11 A perspective view showing how the electronic part connecting terminals are press-fitted into the housing after the insertion of the condensers.
Figure 12:
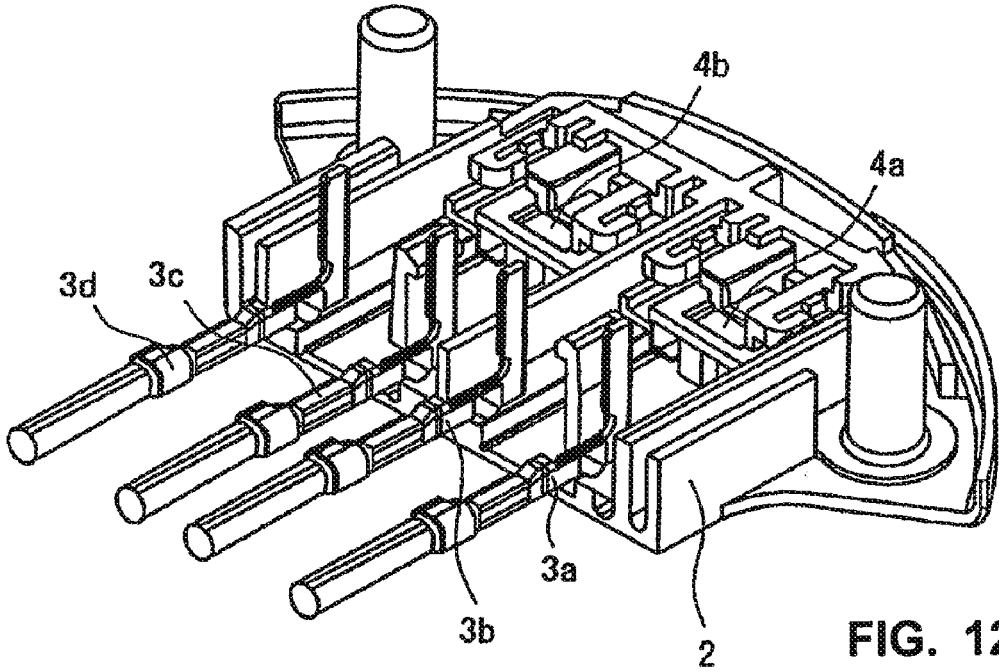
FIG. 12 A view showing how the male terminals are inserted after press-fitting the electronic part connecting terminals into the housing.
Figure 13:
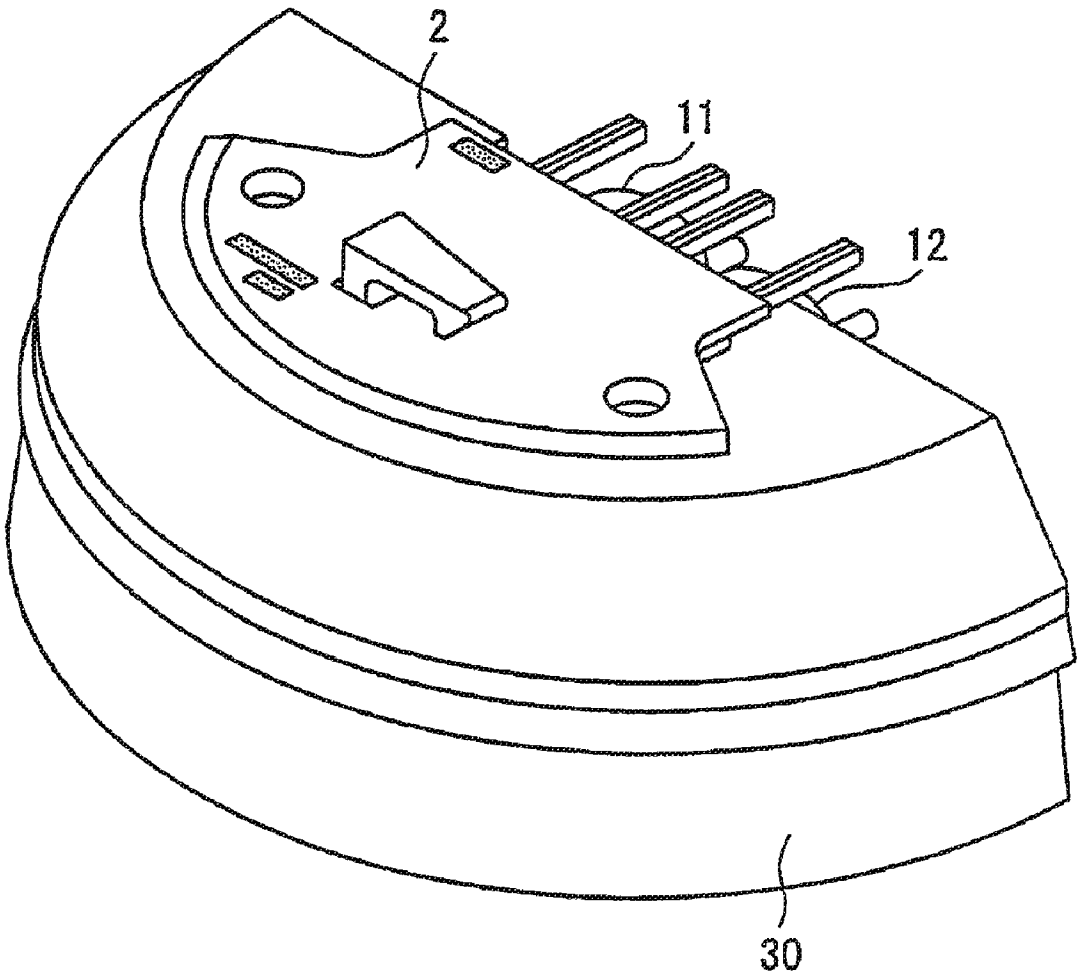
FIG. 13 A perspective view showing a completed assembly including the housing.
Figure 14:
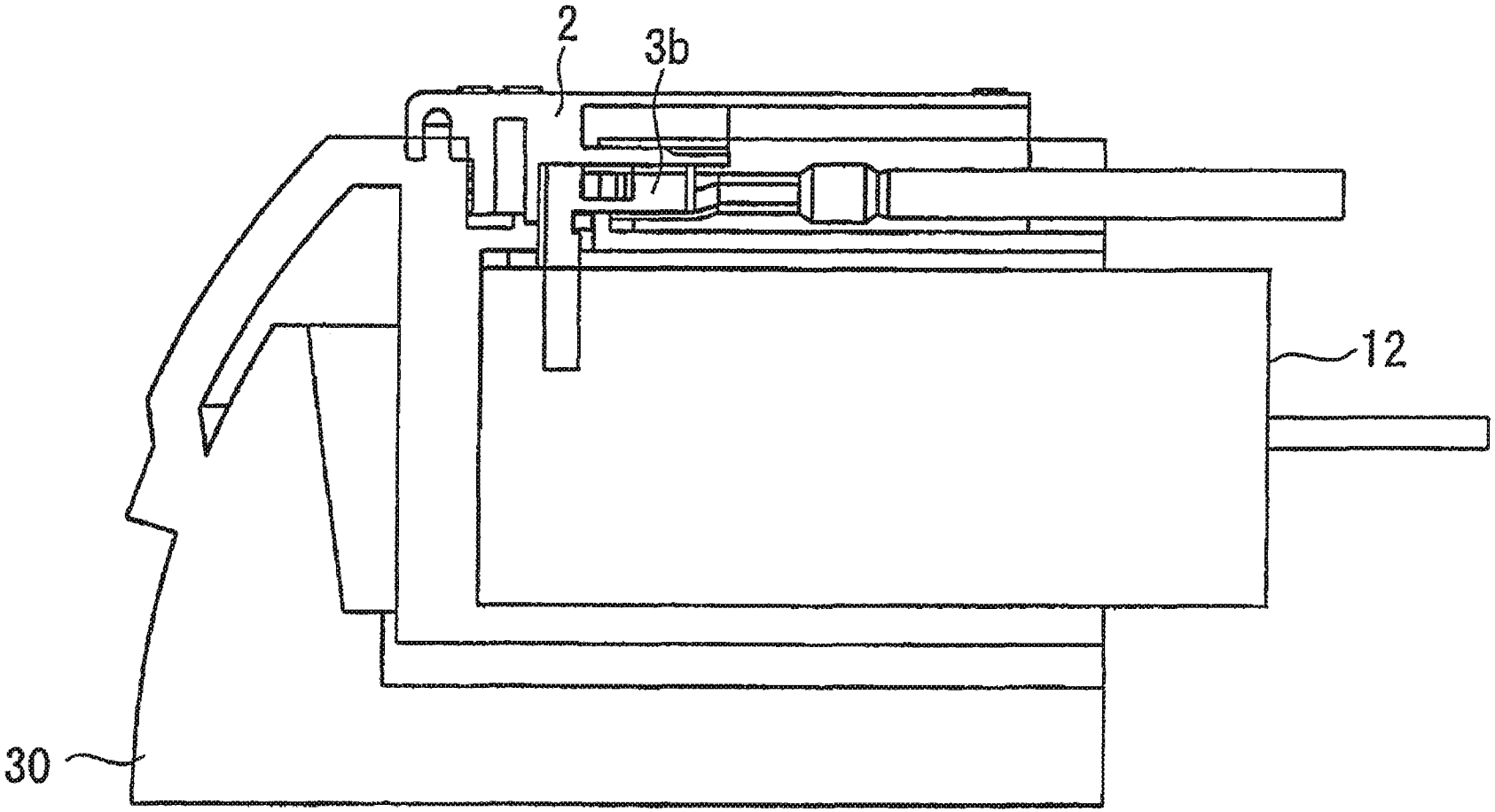
FIG. 14 A view showing the inner structure of the completed assembly including the housing.

What is claimed is:

1. An electronic part connector having a pair of male plug terminals and a pair of electronic part connecting terminals, one being connected to a power supply side and the other being connected to a grounding side, the connection between the power supply side and the grounding side being established by interposing an electronic part between the one and the other of the pair of electronic part connecting terminals, the electronic part connector comprising a housing having the pair of electronic part connecting terminals and the electronic part mounted therein, comprising:

a pair of electronic part connecting terminals press and hold both end portions of the electronic part in mutually opposite directions, and in the Z-axis direction, the pair of electronic part connecting terminals come into contact with a side surface of the electronic part to hold the electronic part at a predetermined position and electrically connected to the male plug terminals; and each of the pair of electronic part connecting terminals comprises a main contact portion that comes into contact with and exerts an elastic force on an end portion of the electronic part to press and hold the electronic part in the Y-axis direction, and an auxiliary contact portion that is substantially orthogonal to a contact surface of the main contact portion and protrudes in the Y-axis direction with respect to the main contact portion to reach a side portion of the electronic part;

wherein each of the main contact portions is formed in a substantially U-shaped configuration to exhibit elasticity, and that a sub contact portion is formed by bending on a plane orthogonal to a plane on which the main contact portion is provided, the sub contact portion extending in a direction opposite to the auxiliary contact portion that is bent inwardly over a rear end of the main contact portion, being formed in a substantially U-shaped configuration to exhibit elasticity, and coming into contact with the male plug terminal connected to the power supply side or the grounding side.

2. An electronic part connector according to claim 1, further comprising a male terminal which is connected to the power supply side or the grounding side at one end and to a member to be supplied with power at the other end, and which comes into contact with the one or the other of the pair of electronic part connecting terminals.

3. An electronic part connector according to claim 1, further comprising wall portions that come into contact with or close to a side surface of the electronic part are formed within the housing to hold the electronic part in the X-axis direction.

4. An electronic part connecting terminal according to claim 1, wherein each of the pair of electronic part connecting terminals has a first contact surface provided in the main contact portion, the first contact surface coming into contact with an end portion of the electronic part, and that the auxiliary contact portion is provided with a second contact surface that comes into contact with a side surface of the electronic part such that the auxiliary contact portion protrudes in the Y-axis direction in a flange-like manner.

5. An electronic part connecting terminal according to claim 1 wherein the pair of electronic part connecting terminals comprise a pair of right and left parts that are plane symmetrical to each other, and that the electronic part is held between the right and left parts.

* * * * *